US010222757B2

(12) United States Patent
Dinger et al.

(10) Patent No.: US 10,222,757 B2
(45) Date of Patent: Mar. 5, 2019

(54) REGULATING SYSTEM FOR A MECHANICAL WATCH

(71) Applicant: The Swatch Group Research and Development Ltd., Marin (CH)

(72) Inventors: Rudolf Dinger, Saint-Aubin (CH); Jean-Pierre Mignot, Areuse (CH); Jean-Jacques Born, Morges (CH)

(73) Assignee: The Swatch Group Research and Development Ltd, Marin (CH)

( * ) Notice: Subject to any disclaimer, the term of this patent is extended or adjusted under 35 U.S.C. 154(b) by 23 days.

(21) Appl. No.: 14/784,175

(22) PCT Filed: Jul. 22, 2014

(86) PCT No.: PCT/EP2014/065736
§ 371 (c)(1),
(2) Date: Oct. 13, 2015

(87) PCT Pub. No.: WO2015/018636
PCT Pub. Date: Feb. 12, 2015

(65) Prior Publication Data

US 2016/0070235 A1 Mar. 10, 2016
US 2018/0181072 A2 Jun. 28, 2018

(30) Foreign Application Priority Data

Aug. 5, 2013 (CH) ..... 1354/13

(51) Int. Cl.
*G04C 5/00* (2006.01)
*G04C 3/08* (2006.01)
*G04C 3/10* (2006.01)

(52) U.S. Cl.
CPC ..... *G04C 5/005* (2013.01); *G04C 3/08* (2013.01); *G04C 3/101* (2013.01); *G04C 3/104* (2013.01); *G04C 3/105* (2013.01); *G04C 5/00* (2013.01)

(58) Field of Classification Search
CPC ..... G04C 3/08; G04C 3/101; G04C 3/104; G04C 3/105; G04C 5/00; G04C 5/005
(Continued)

(56) References Cited

U.S. PATENT DOCUMENTS 2,971,323 A 2/1961 Hetzel
3,207,965 A * 9/1965 Lavet ..... G04C 3/10 368/167
(Continued)

FOREIGN PATENT DOCUMENTS

DE 1 177 077 8/1964
EP 1 967 919 B1 6/2009
(Continued)

OTHER PUBLICATIONS

International Search Report dated May 29, 2015 in PCT/EP14/065736 Filed Jul. 22, 2014.

*Primary Examiner* — Daniel Wicklund
(74) *Attorney, Agent, or Firm* — Oblon, McClelland, Maier & Neustadt, L.L.P.

(57) ABSTRACT

Regulating members for a mechanical timepiece, specifically a system based on magnetic interaction between a resonator, in a form of a tuning fork for example, and an escape wheel, as a magnetic escapement. In the system plural areas of magnetic interaction between the resonator and the escape wheel are arranged such that torques produced at the escape wheel by the interactions compensate each other if the escape wheel is not synchronized at the frequency of the resonator. This results in negligible torque in the escape wheel when the escape wheel rotates slowly in
(Continued)

a direction of an arrow or opposite direction. This allows the timepiece to start with a low mainspring torque and without any start procedure or device and provides better resistance of the timepiece against a loss of synchronization in event of a shock.

11 Claims, 7 Drawing Sheets

(58) Field of Classification Search
USPC ..... 368/124–126
See application file for complete search history.

(56) References Cited

U.S. PATENT DOCUMENTS 3,208,287 A * 9/1965 Ishikawa ..... G04C 5/005 368/126
3,515,914 A * 6/1970 Steinemann ..... G04C 3/10 368/157
3,577,874 A * 5/1971 Mutter ..... G04C 3/105 368/126
3,591,814 A * 7/1971 Clifford ..... G04C 3/101 368/126
3,652,955 A * 3/1972 Cruger ..... G04C 3/024 368/158
3,678,307 A * 7/1972 Clifford ..... G04C 3/107 368/167
3,719,839 A * 3/1973 Endo ..... G04C 3/061 368/126
2012/0269043 A1* 10/2012 Baudet ..... G04C 5/005 368/126
2013/0170330 A1* 7/2013 Hessler ..... G04B 13/00 368/324
2013/0279302 A1 10/2013 Vardi

FOREIGN PATENT DOCUMENTS

EP 2 336 832 A2 6/2011
EP 2 466 401 A1 6/2012
GB 1128394 9/1968
GB 1128394 A * 9/1968 ..... G04C 5/005

* cited by examiner

REGULATING SYSTEM FOR A MECHANICAL WATCH

This is a National Phase Application in the United States of International Patent Application PCT/EP2014/065736 filed Jul. 22, 2014 which claims priority on Swiss Patent Application No. 1354/13 filed Aug. 5, 2013. The entire disclosures of the above patent applications are hereby incorporated by reference.

DESCRIPTION

The present invention concerns the regulating system of a mechanical timepiece. The "regulating system" or "regulating member" means two distinct devices: the resonator and the escapement.

The resonator is the member producing a periodic motion which forms the time base of the timepiece. Well known resonators are pendulums that oscillate under the effect of gravity, balances that form with the associated balance-spring a mechanical oscillator resonating about the balance staff and tuning forks that oscillate through elastic deformation of their structure. The best known embodiment of a tuning fork is the tuning fork used in music, however the most widely manufactured is the resonator produced from quartz crystal and used as a time base for electronic watches.

The escapement is the connecting element between the timepiece gear train and the resonator. The escapement has two functions: First of all, it must transmit to the resonator the energy required to maintain oscillation. This function is normally performed by a mechanism that transmits to the resonator energy from the last wheel of the gear (referred to here as the "escape wheel"). In addition to transmitting energy powering the resonator, the escapement must also control the speed of advance of the gear train and synchronise it with the oscillation of the resonator. This second function is normally performed by a portion of the escapement mechanism which engages in the teeth of the escape wheel and only allows the active tooth to pass when the resonator has completed an oscillation. Many escapement principles are known in horology, the escapement most used in the field of wristwatches is the lever escapement, more particularly the Swiss lever escapement, which is cited here merely by way of example. A description of the Swiss lever escapement can be found, for example, in EP Patent Application No 2336832A2.

Mechanical escapements can only perform their functions by means of direct mechanical contact with the teeth of the escape wheel and with the resonator. In the example of the Swiss lever escapement, the pallet-lever is in contact with the resonator while the latter is close to the point of equilibrium and it is almost permanently in contact with one of the escape wheel teeth. The situation is worsened by the fact that, in a mechanical escapement, contacts with both the escape wheel teeth and with the resonator are at least partially accompanied by a slipping motion between the two contacting elements. A slipping motion necessarily involves friction losses which have several harmful consequences.

A major drawback of contact with the resonator involving friction is that this perturbs the movement of the resonator with forces that are not so-called "elastic" type forces. This means that the resonator is perturbed by forces that affect its natural frequency. This perturbation affects the timekeeping performance of the watch. It is easily understood that perturbation of the motion of the resonator depends on the extent of interaction of the escapement with the resonator. Since the escape wheel is driven by the gear train and the latter by the mainspring, the chronometric error created by contact between the escapement mechanism and the resonator depends on the state of the mainspring: the chronometric error is different if the mainspring is very taut compared to the situation of a watch where the mainspring is almost completely unwound. This chronometric error is well known to those skilled in the art by the name "isochronous error".

In addition, the slipping motion involves friction and consequently energy losses. In order to reduce energy losses due to friction, the elements in contact are very carefully greased or oiled and very advanced lubricating products are used. This makes it possible to reduce friction losses, but means, however, that chronometric performance becomes dependent on the performance of the lubricants. Such performance varies over time, as the lubricants deteriorate or do not stay on the surface to be lubricated. As a result of this phenomenon, the performance of the watch deteriorates and it has to be cleaned and lubricated again.

Many developments have been made to reduce the slipping contact between the escapement mechanism and the resonator. By way of example, EP Patent No 1967919B1 discloses a coaxial escapement improving the conditions of energy transmission between the escape wheel and the resonator. Although this type of escapement is an improvement with respect to the Swiss lever escapement, it cannot prevent slipping contacts and consequently cannot prevent the aforementioned losses due to friction.

Friction losses can, however, be avoided if the transmission of energy by mechanical contact is replaced with contactless transmission, for example by magnetic or electrostatic forces. Such forces evidently have no friction losses. An escapement where mechanical contacts are replaced by magnets is called a magnetic escapement. Magnetic escapements have been known for a very long time. H. S. Baker was the first to file a Patent (US) for a magnetic escapement in 1927, followed by C. F. Clifford (1938) and R. Straumann in 1941. These developments led to industrial production: the German company Junghans produced an alarm clock provided with a magnetic escapement at the beginning of the 1960s. A description of this escapement is found in the article by C. F. Clifford in the April 1962 edition of the "Horological Journal". However, this escapement only performed half of the conventional functions of an escapement: it synchronized the escape wheel to the motion of the oscillator, but the tuning fork oscillator was electrically driven. It was not therefore a mechanical movement, but rather an electromechanical or electronic watch (or alarm clock). The superior performance of electronic quartz movements and their lower cost price resulted in a complete loss of interest in magnetic escapements in the 1970s. The increasing interest in mechanical watches is behind recent developments in this field: EP Patent Application No 2466401A1 discloses an embodiment which may be considered to be the state-of-the-art. This document describes all the regulating members of a mechanical watch, the resonator and the escapement. The resonator is a tuning fork resonator in a similar form to known tuning forks for music. In fact, the tuning fork resonator has a great number of advantages with respect to the sprung balance resonator. Firstly, it does not require bearings and consequently its quality factor is not damaged by friction in the bearings (it has fewer losses per oscillation) and the tuning fork resonator does not need lubrication likely to require regular servicing of the watch. It is also well known that the tuning fork resonator provides much better chronometric efficiency than a sprung balance resonator. Max Hetzel and the Bulova company have produced wristwatches fitted with tuning fork resonators, the Patent was filed in 1953 and the technology used is described, for example, in U.S. Pat. No. 2,971,323. Three producers have sold more than six million watches following the principles described in that document: Bulova with its product named "Accutron", Citizen with the product named "HiSonic" and Ebauches SA with a product named "Swissonic 100" or "Mosaba". These three products were not, however, mechanical watches. The tuning fork resonator was driven and maintained in oscillation by an electronic circuit supplying electrical impulses to two coils located opposite magnets attached to the ends of arms of the tuning fork similar to the product of the aforementioned Junghans company. The gear train was driven by the tuning fork by means of a click mechanism attached to one of the arms. The energy for operation of the watch was provided by the electrical power source of the transistor drive circuit of the tuning fork. These were in fact electrical or electronic watches. These products demonstrated the superior chronometric performance of a tuning fork resonator with respect to a sprung balance resonator: their operating precision was better than that of a watch provided with a sprung balance resonator. It is also well known that the accuracy of an electronic quartz watch is much better than that of a mechanical watch. This is also due to the stability of the quartz tuning fork resonator regulating the rate of these products.

The choice of a tuning fork resonator is therefore wise and EP Patent Application No 2466401A1 shows the tuning fork provided with two magnets (one magnet on each arm) similar to the aforementioned tuning forks. The escapement function is performed, in this document, by an escape wheel carrying a multitude of magnets located between the arms of the tuning fork and such that the tuning fork magnets are opposite a pair of magnets of the escape wheel as shown in FIG. 1 of the present Patent Application. The operation of the magnetic escapement according to EP Patent Application No 2466401A1 is described in that document and is only briefly summarized here for the description of the invention that forms the subject of the present Application. It is understood that, if the escape wheel magnets face tuning fork magnets having the correct polarity (one N pole opposite one S pole), the tuning fork arms are drawn towards the escape wheel, if the magnets facing each other have identical polarity, the tuning fork arms are pushed outwards. In rotation, the escape wheel will alternately transmit a force to the tuning fork arms pushing the arms outwards and then drawing them inwards. It is understood that rotation of the escape wheel will excite vibration of the tuning fork. A resonator is characterized in that its amplitude of vibration becomes very large when it is excited at its natural resonant frequency and this is also the case of the tuning fork resonator described in EP Patent Application No 2466401A1. When the escape wheel approaches the rotational speed that excites the tuning fork at its natural resonant frequency, the amplitude thereof becomes substantially greater. As will be shown below in the detailed description of the invention, the tuning fork magnets also exert a tangential force on the escape wheel magnets. This tangential force acts to brake the escape wheel when it starts to get ahead of the speed given by the oscillations of the tuning fork. It is this tangential force which synchronizes the escape wheel speed to the tuning fork frequency and consequently controls the rate of the watch.

The device according to EP Patent Application No 2466401A1 has, however, several drawbacks which result from the fact that the tuning fork interacts with the escape wheel so as to produce tangential forces which vary greatly when the wheel advances by one tooth. It is easily understood that the tangential forces acting on the escape wheel produce a torque which draws the wheel into the position where the magnets on the wheel and on the tuning fork are facing each other and of opposite polarity. This is the stable position of equilibrium. Starting from the stable position of equilibrium and rotating the escape wheel, for example in the clockwise direction, the interaction between the magnets on the wheel and on the tuning fork will first of all create a torque drawing the wheel back into the position of equilibrium. This is the case until magnets of identical polarity are opposite each other. In this situation, the arrangement of the magnets is symmetrical again and there are no tangential forces and therefore no torque on the escape wheel. This position is the unstable position of equilibrium of the wheel. If the escape wheel continues to rotate in the same direction a torque drawing the wheel towards the next stable position of equilibrium develops. It is observed that the tangential forces exerted on the escape wheel by the system disclosed in EP Patent Application No 2466401A1 vary enormously when the wheel advances from one stable position of equilibrium to the next. This situation has several significant drawbacks.

The first consequence is the fact that the escape wheel is locked by forces from the magnets when it is stationary. It is easily understood that, if the escape wheel magnets are opposite the tuning fork magnets and of opposite polarity, the two pairs of magnets attract each other and the escape wheel remains locked in this position. This situation arises each time that the gear train of the watch is stopped, which occurs if the watch is not worn and stops at the end of its power reserve, but also during time setting operations when the gear train is stopped in order to be restarted at the precise second. This phenomenon is well known and typical of timepieces provided with a prior art magnetic escapement. Timepieces provided with C. F. Clifford type magnetic escapements had sophisticated mechanisms for starting the escape wheel when the movement was started up.

The second drawback of the system described in EP Patent Application No 2466401A1 is its tendency to desynchronize in the event of a shock. Placing magnets both on the escape wheel and on the tuning fork arms results in significant forces between the two regulating members. The mechanical power required to synchronize a mechanical watch is however very small. Since mechanical power is given by the product of tangential force and speed, it is observed that significant forces necessarily lead to low speeds. In the case of a rotational motion, they lead to a low rotational speed of the escape wheel. Wristwatches are subjected to quite violent shocks. If the watch drops to the ground, shocks of several thousand times the earth's acceleration are reached. Even during normal use, shocks generating accelerations much higher than the earth's acceleration are frequent. A shock is generally not simply a linear acceleration, the watch usually touches or is dropped on an edge of the timepiece so that the acceleration is a combination of linear acceleration and angular acceleration. If the angular component of the acceleration due to the shock accelerates the escape wheel at an angular speed exceeding the speed of synchronization with the tuning fork, the aforementioned synchronization mechanism will no longer work and the escape wheel continues to accelerate, driven by the gear train and the mainspring of the watch. In such case, the watch loses all its chronometric qualities, the hands rotate at far too high a speed. The risk of desynchronization in a system according to EP Patent Application No 2466401A1 is also high because synchronization between the escape wheel and the motion of the tuning fork resonator occurs at relative positions of the two members where the forces of attraction are high and this only occurs once per oscillation of the resonator in the position shown in FIG. 1.

Another drawback of the embodiment according to EP Patent Application No 2466401A1 relates to the shape of the tuning fork described in that document. The tuning fork resonator is, in fact, a tuning fork in the form of an oscillating bar, bent into a U shape. This type of tuning fork is well known in the field of music and used for tuning instruments. It is known from its application in music that this type of tuning fork transmits its vibration through the handle attached to the middle of the U of the tuning fork. The musician knows that the sound of the tuning fork is much more audible if the tuning fork is placed on a surface capable of vibrating at its frequency, for example on the lid of a piano. This is due to the fact that the tuning fork transmits its vibrational energy through its handle to the piano lid which—given its large surface area—transmits it to the air like a loudspeaker. A timepiece resonator however, should retain its energy inside the resonant structure and not lose it in the attachment member, losses in the attachment member degrade its quality factor and consequently its chronometric properties. Attachment to the stem of a U shaped tuning fork is consequently very disadvantageous. EP Patent Application No 2466401A1 mentions the fact that the U shaped tuning fork has two points that remain stationary, the nodes (or nodal axes). The U shaped tuning fork could theoretically be attached to its support at these two points. In the conditions of a wristwatch in particular, and in light of the high accelerations that it must withstand, this solution is not, however, achievable: either the tuning fork attachment member is actually small enough not to perturb the vibration of the resonator, in which case the device is not shock resistant, or the device is shock resistant in which case the attachment member is physically too large and results in significant energy losses. It is clear that it is not possible to mount the U shaped tuning fork in the timepiece movement in a manner satisfying the conditions required by this application.

It is an object of the present invention to overcome the drawbacks of prior art magnetic escapements by providing a system for regulating a mechanical timepiece based on the magnetic interaction between a resonator and an escape wheel, said interaction creating radial and tangential forces acting on the escape wheel 9 and generating torques therein, characterized in that the system is arranged so that the torques due to said tangential forces act in opposite directions and cancel each other out when the resonator is stationary and a torque is applied to the escape wheel.

This object is achieved with a magnetic escapement interacting with the resonator with negligible and generally lower tangential forces when the resonator is stationary so as to allow the escape wheel to rotate at a sufficiently high speed to render the timepiece resistant to shocks. One of the preferred embodiments of the invention makes it possible to synchronize the escape wheel with the tuning fork resonator at each half oscillation of the tuning fork resonator which further increases shock resistance. The tuning fork resonator according to one of the embodiments of the invention has a structure allowing secure insertion which ensures that both the resonator and its assembly are resistant to shocks.

The invention is explained in more detail with reference to the annexed Figures, in which:

FIG. 1 shows the prior art, notably the system according to EP Patent Application No 2466401 A1.

FIG. 1*a* shows the rotating device of FIG. 1 and the tangential forces acting on the escape wheel when the resonator is stationary.

FIG. 1*b* shows a graph of the tangential forces in FIG. 1*a* during the rotation of the escape wheel from one position of equilibrium to the next.

Figure 1:
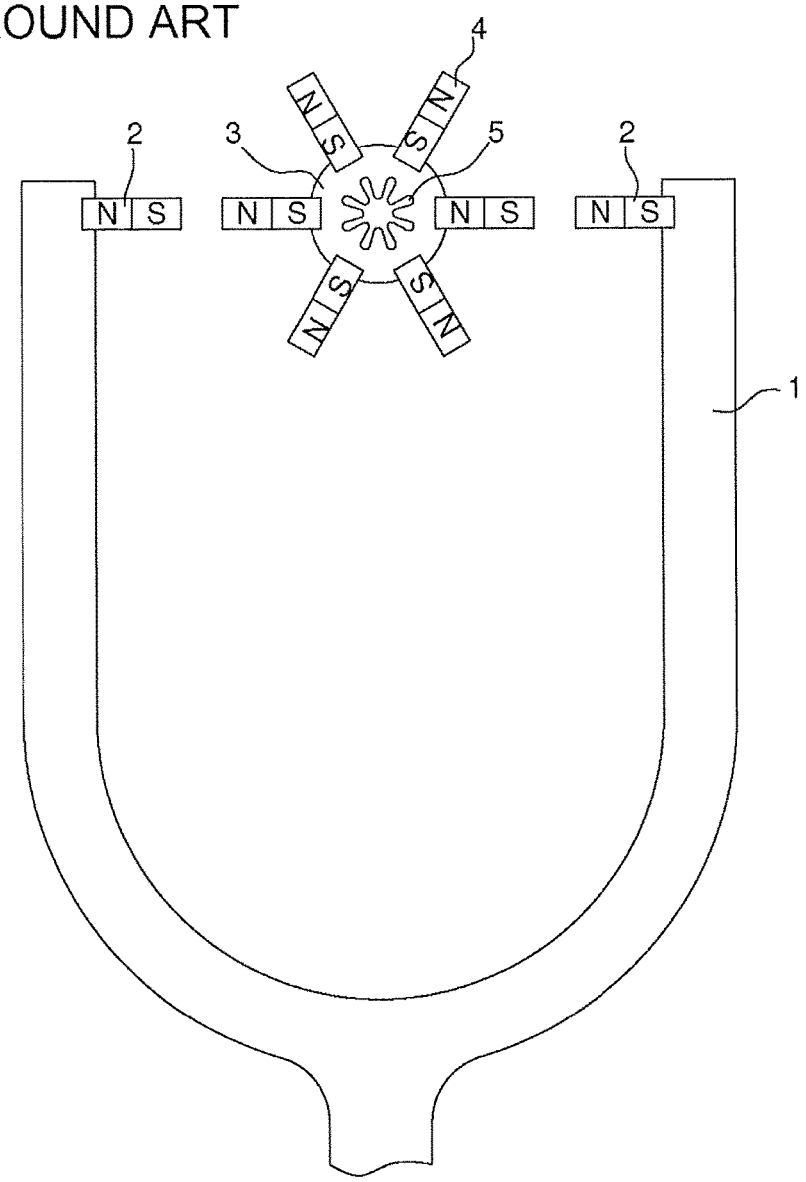
Fig. 1 BACKGROUND ART

Referring to the Figures, the invention will be explained in detail. FIG. 1 shows the prior art according to EP Patent Application No 2466401 A1. The U shaped tuning fork resonator 1 carries at the end of each arm a permanent magnet 2 oriented so that the magnetic fields created by the magnets are in the same direction. Escape wheel 3 is arranged between the arms of the tuning fork and, in the example shown, carries six permanent magnets 4 oriented alternately in order to present opposite or identical magnetic poles to the tuning fork magnets. The escape wheel also carries the pinion 5 meshing in the gear train of the timepiece.

Figure 1A:
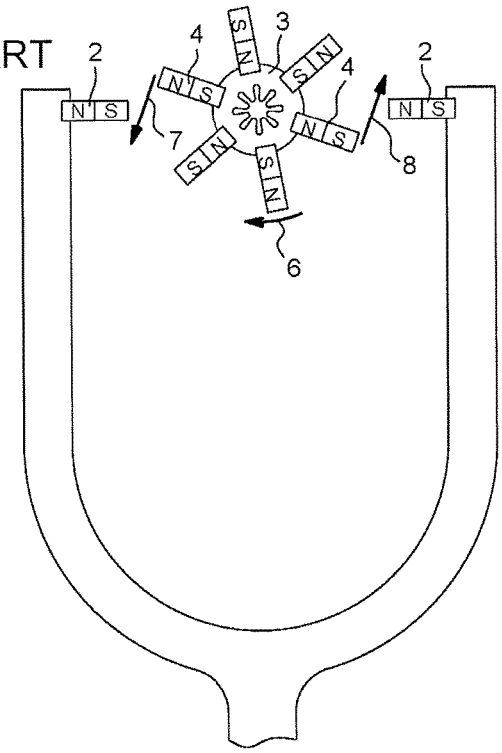
Fig. 1a BACKGROUND ART

FIG. 1*a* shows the tangential forces that develop when the escape wheel rotates slowly and the resonator is stationary. This is the start situation of the timepiece movement. Since the geometry in FIG. 1 is symmetrical with respect to a plane through the axis of the wheel and passing through the tuning fork magnets, there can be no tangential force. When the escape wheel rotates, for example in the clockwise direction as indicated by arrow 6, the magnets of opposite polarity attract each other, which will produce forces 7, 8. It is noted that the two tangential forces produce a torque on the escape wheel which acts in the same direction and against rotation in the direction of arrow 6.

Figure 1B:
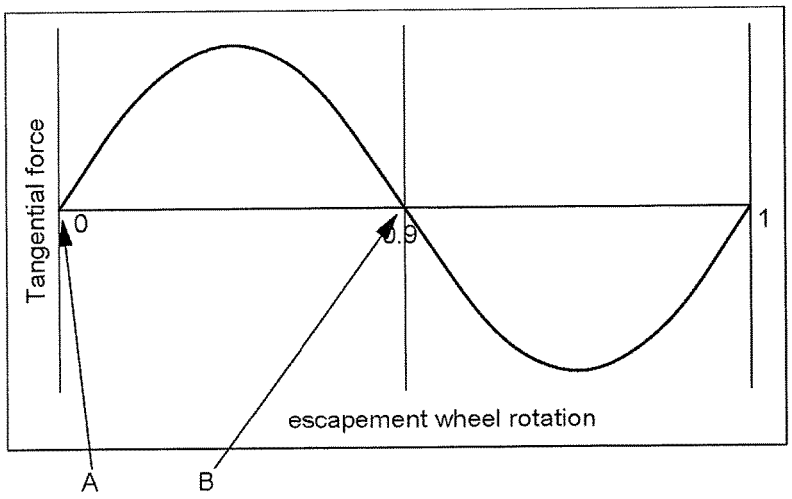
Fig. 1b BACKGROUND ART

FIG. 1*b* shows the resulting tangential force (the sum of the two forces 7 and 8 shown in FIG. 1*a*) of the prior art in FIG. 1, as a function of the angle of rotation of escape wheel 3. The angle of rotation shown corresponds to the advance of the escape wheel from one stable position of equilibrium to the next. The motion starts with angle of rotation 0 in the situation shown in FIG. 1. This situation corresponds to the stable equilibrium of the escape wheel and it is indicated by the arrow designated A. In rotating as shown in FIG. 1*a* towards the position where the escape wheel magnets are opposite the tuning fork magnets but of identical polarity, the escape wheel will have completed half the rotation (designated 0.5) and reaches the unstable position of equilibrium. This position is designated by arrow B in FIG. 1*b*. In this first half of the rotational motion, the tangential force is positive and acts against rotation of the escape wheel. As soon as the unstable point of equilibrium B is passed, the tangential force draws the escape wheel in the direction of rotation, in the diagram in FIG. 1*b* this is shown by negative forces. At the end of the rotation, at the angle of rotation designated 1, the escape wheel will again be in position A, but it will have advanced one step. In the situation shown in FIG. 1, this step corresponds to a 120° rotation of the escape wheel.

Figure 2:
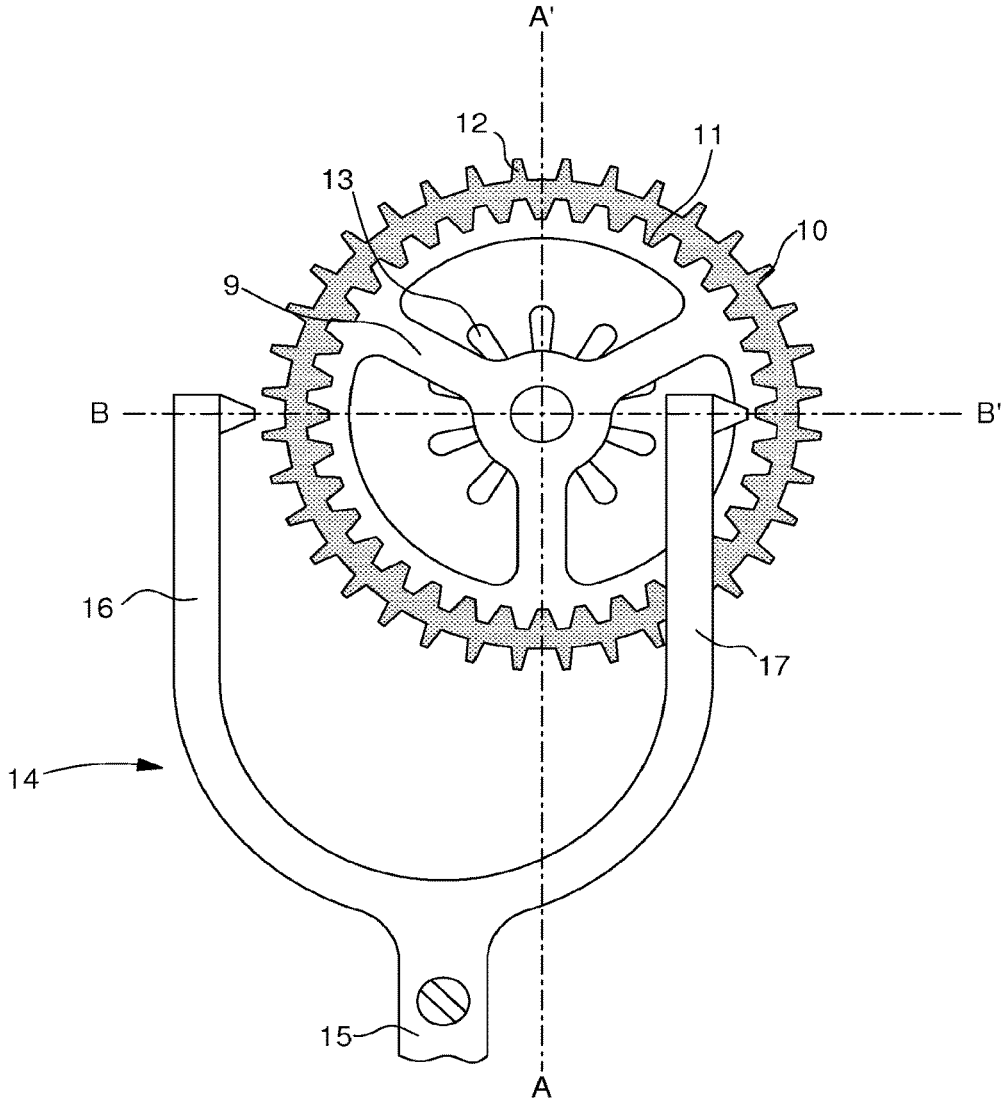
FIG. 2 shows the device according to a preferred embodiment of the invention.

FIG. 2 illustrates one of the preferred embodiments of the present invention. Escape wheel 9 carries a crown made of ferromagnetic material 10 provided with an inner toothing 11 and outer toothing 12. The escape wheel meshes in the gear train of the timepiece by means of pinion 13. The timepiece gear train and its mainspring (contained in the barrel) are well known and are not shown in the Figures. Tuning fork resonator 14 is located above ferromagnetic crown 10. The tuning fork resonator comprises two arms 16 and 17 attached to a solid base 15. The embodiment schematically shown in FIG. 2 is explained in more detail with reference to FIGS. 3 and 4, which shown cross-sections through the structure in planes A-A' and B-B', the view in these cross-sections is in the direction of the arrows in FIG. 2.

Figure 3:
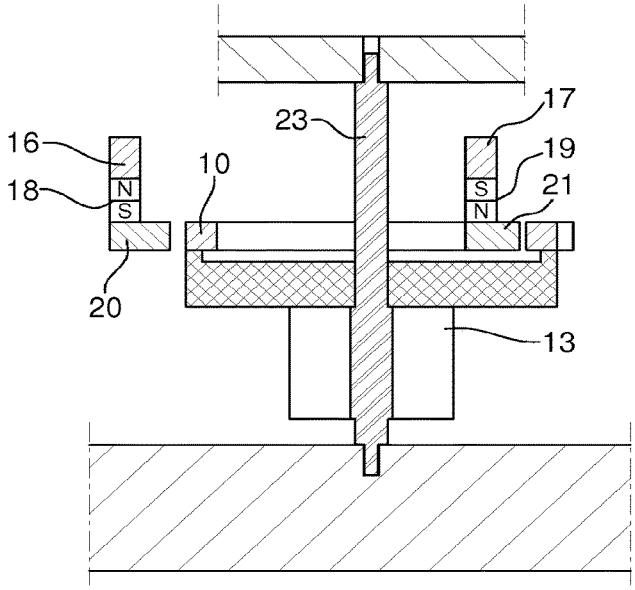
FIG. 3 shows a section through the device shown in FIG. 2 in the plane B-B'.

FIG. 3 is a central section through the escape wheel in plane B-B' showing the interaction between the ferromagnetic structure and the tuning fork resonator. The hatched surfaces correspond to sectioned portions of the structure, while the white surfaces are surfaces visible outside the sectional plane. The two arms of the tuning fork 16 and 17 that are seen here sectioned close to their free end carry magnets 18 and 19. The indication "N/S" on the magnets indicates their polarity. The lower side of the magnets carries the magnet pole pieces 20 and 21 which direct the magnetic flux towards ferromagnetic structure 10 of the escape wheel. In the position shown in FIGS. 2 and 3, the right pole piece 21 is opposite one tooth of the ferromagnetic structure while the left pole piece 20 is between two teeth.

Figure 4:
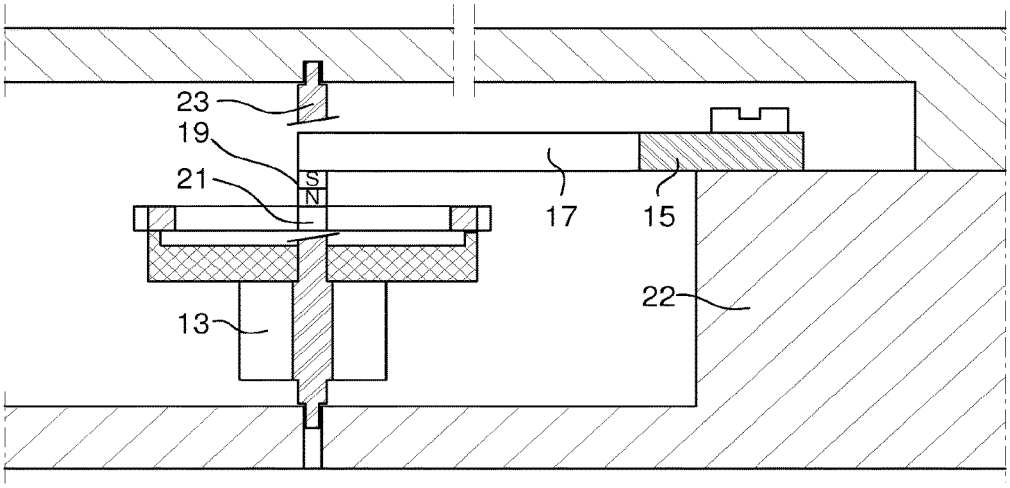
FIG. 4 shows a section through the device of FIG. 2 in the plane A-A'.

FIG. 4 shows the central section along plane A-A'. The Figure shows the assembly of the tuning fork in the frame of movement 22, this part is normally called the "main plate" by those skilled in the art and, in a highly schematized manner, the escape wheel bearing. The central section through the escape wheel is shown, the wheel arbor 23 being interrupted in the area of the magnets and the tuning fork to represent these elements which are outside the sectional plane. The stem of tuning fork 15 is shown in cross section to reveal the rigid assembly made possible by the tuning fork structure according to the invention.

Referring to the Figures, the operation of the regulating members according to the invention will now be described in detail. FIGS. 2 and 3 show that the embodiment according to the invention causes the tuning fork to interact with the ferromagnetic crown with its outer toothing on one arm of the tuning fork (arm 16) and with the inner toothing on the other arm (arm 17). It is also noted that interaction with the toothed crown alternates, when the pole piece of the right arm 17 is opposite a tooth of the ferromagnetic crown 10, the pole piece of the other arm 16 is between two teeth. It is well known that a part made of ferromagnetic material is attracted by a magnet and it is noted that the rotation of the escape wheel will produce forces that act in the radial direction and vary according to the relative angular position of the teeth of the ferromagnetic crown and the pole pieces of the tuning fork. Since the tuning fork is a structure capable of vibrating and entering resonance, it will be excited by rotation of the escape wheel even if the escape wheel does not carry magnets, as is the case in the prior art.

Figure 5:
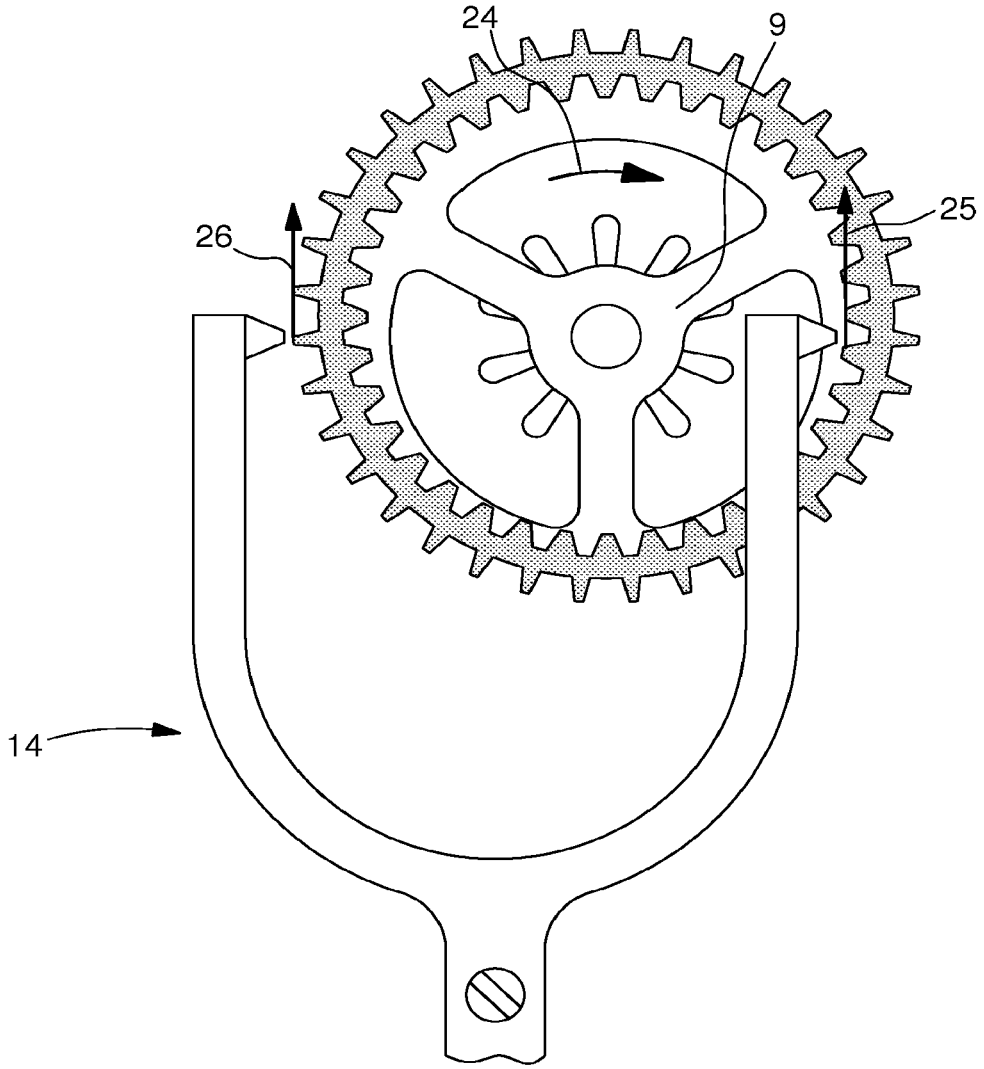
FIG. 5 shows the tangential forces acting on the escape wheel in the device of FIG. 2 when the resonator is stationary.

FIG. 5 shows the tangential forces 25 and 26 that develop in the structure according to the invention when the escape wheel rotates in the direction of arrow 24. It is seen that, when the escape wheel rotates in the clockwise direction with respect to its position of equilibrium, one pole piece of the tuning fork moves away from a tooth of the ferromagnetic structure while the other moves closer. This will produce tangential forces represented by arrows 25 and 26 and it is noted that the two tangential forces produce torques at the escape wheel in opposite directions. Consequently, the torques created by the tangential forces cancel each other out.

Figure 6:
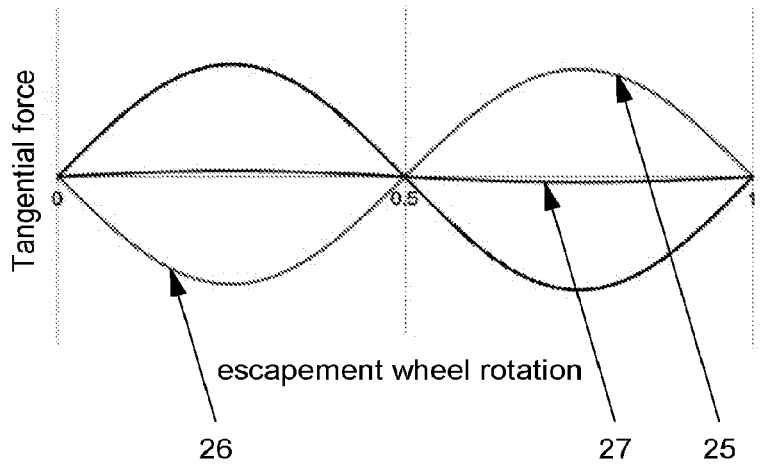
FIG. 6 shows a graph of the tangential forces in FIG. 5 acting on the escape wheel during the rotation of the wheel through one tooth.

FIG. 6 is a graphical representation of tangential forces 25 and 26 as a function of the angle of rotation of the escape wheel. It is noted that the two forces 25 and 26 oppose each other giving the very low resultant force, designated 27. If the two magnets are properly magnetically charged, the resulting force 27 is zero, the inevitable manufacturing tolerances mean, however, that the two forces 25 and 26 do not compensate each other exactly and this results in the low force 27 shown in FIG. 6. By way of example, if the magnetic charge of one of the magnets deviates from the design value by 1%, force 27 will also have a value corresponding to 1% of forces 25 or 26 respectively. It is noted that the system according to the invention makes it possible to reduce the resulting tangential force in a very considerable manner with respect to the prior art. The scale of rotation of the wheel covers the advance of the wheel by one tooth, in the situation corresponding to FIG. 2 there are 36 teeth, the wheel will have traveled 10° in the designated range from 0 to 1 on the axis of rotation of the wheel.

The situation shown in FIG. 6 is valid for a rotational speed of the escape wheel remote from resonance, typically at the start-up of the wheel and it is observed that the resulting tangential force 27 is very low, theoretically even zero. This allows the timepiece to start working without any additional starting device, which makes the mechanism of the timepiece regulating members considerably simpler and more reliable.

If the rotational speed of the escape wheel approaches the value generating excitation of the tuning fork at its resonance frequency, the amplitude of vibration of the arms becomes high and may reach several hundredths of millimeters. The higher the vibration amplitude of the tuning fork, the more the interaction between the oscillating tuning fork and the rotating escape wheel will create high tangential forces, forcing the wheel to rotate synchronously with the motion of the tuning fork resonator. In fact it was discovered that the tangential forces increase more than linearly with the vibration amplitude of the tuning fork. Compared to the forces illustrated in FIG. 6, the tangential forces become more than twenty times greater if the tuning fork is in resonance.

Figure 7:
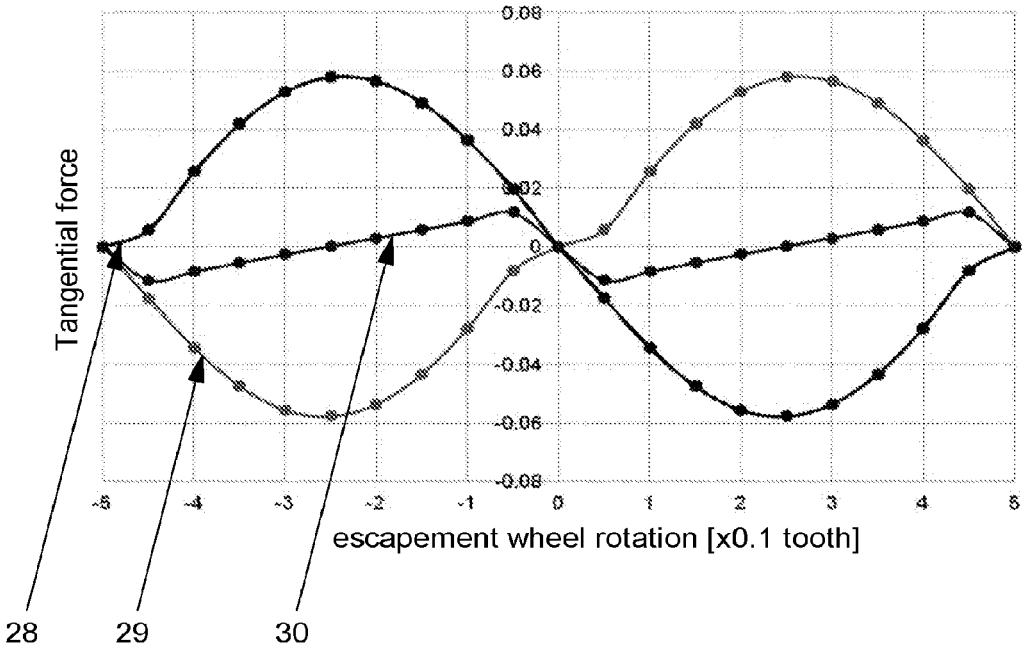
FIG. 7 shows the tangential forces on the escape wheel of the device according to the invention when the tuning fork vibrates at its resonant frequency and synchronizes the speed of the escape wheel.

FIG. 7 shows the tangential forces acting on the escape wheel when the escape wheel is synchronized to the frequency of the tuning fork resonator. The result illustrated in FIG. 7 shows the magnetic forces of the device illustrated in FIG. 2. The horizontal axis indicates the rotation of the escape wheel by one complete tooth. At the zero position, the tooth is opposite the pole piece as shown in FIG. 2. At positions 5 and −5, the wheel is turned by a half-tooth, the range of rotation illustrated in FIG. 7 corresponds to the rotation of the wheel by one complete tooth. The vertical axis is that of the tangential forces. Curve 28 shows the force exerted by the pole piece on arm 17, curve 29 the negative value of the force exerted by the pole piece on arm 16 and curve 30 gives the sum of the two curves. The Figure shows the situation when the escape wheel is synchronized to the oscillation of the tuning fork. This condition is fulfilled when the escape wheel rotates by one tooth in the time that the resonator completes one oscillation. It is noted that the tangential force shown in curve 30, which indicates the sum of the forces of the two arms, is substantially lower than one or other of forces 28 and 29. It could be inferred from FIG. 7 that the tuning fork, even when oscillating at high amplitude, is not able to synchronize the escape wheel to its natural frequency. The resulting tangential force is in fact low and it is noted that the force also has positive and negative components which are of similar size, so that the overall result covering the resultant force during the advance by one complete tooth will be very low. This is due to the fact that FIG. 7 shows the situation where the tuning fork resonator vibrates exactly in phase with the rotation of the escape wheel. This means that the tooth of toothing 11 is exactly opposite the pole piece of arm 17, when the tuning fork is at the end thereof and remote. In this situation, there is in fact no transfer of energy between the resonator and the escape wheel. However, this case is only of interest for explaining the synchronization mechanism, in reality it does not exist. The escape wheel, which is driven by the mainspring of the timepiece, via the gear train, normally tends to rotate faster than the tuning fork resonator oscillates. The motion of its teeth is faster than the vibration of the tuning fork. Those skilled in the art refer to the advance of the wheel with respect to the motion of the tuning fork the "phase shift". The phase shift is measured in °, 0° means that there is no phase shift; at 180° the phase shift corresponds to an advance of a half-tooth and at less than 180° the escape wheel would be half a tooth behind.

Figure 8:
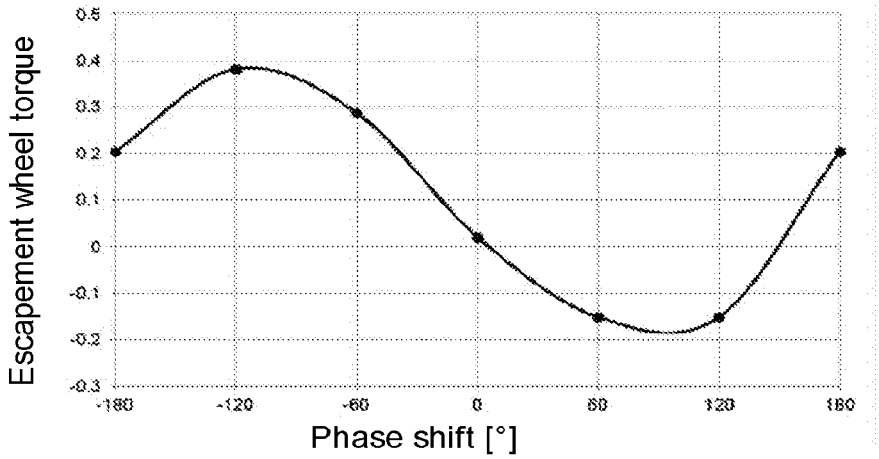
FIG. 8 shows the torque produced by the tangential forces on the escape wheel of the device according to the invention when the escape wheel is synchronized to the oscillation of the resonator as a function of the phase shift between the oscillating motion of the tuning fork and the rotation of the escape wheel.

FIG. 8 shows the torque resulting from the interaction between the vibrating tuning fork and the escape wheel according to the phase shift between rotation of the escape wheel and vibration of the resonator. The tangential forces of the two arms of the tuning fork are multiplied by their corresponding radius to obtain the torque acting on the escape wheel and the vertical axis indicates the sum of the two torques and thus the resulting torque on the escape wheel. Negative torque values in FIG. 8 correspond to a torque that brakes the escape wheel, positive torque values accelerate the escape wheel. FIG. 8 shows that in the range from 0 to 100° approximately, the braking torque acting on the escape wheel increases continuously with the phase shift. This means that the greater the drive torque of the escape wheel, the greater the phase shift of the escape wheel with respect to the motion of the tuning fork. Conversely, if there is no longer any torque driving the escape wheel, the phase shift drops to zero. This case arises when the mainspring is at the end of its power reserve and the timepiece stops. FIG. 8 clearly shows that the rotational speed of the escape wheel is synchronized to the frequency of the tuning fork as long as the mainspring manages to drive the timepiece. The phase shift of the two synchronized motions determines the torque braking the escape wheel and synchronizes the wheel to the frequency of the tuning fork resonator.

FIG. 8 corresponds to the situation where a resonator vibrates with a fixed amplitude. This is not the case however. If the resonator brakes the escape wheel, there is necessarily a transfer of energy from the wheel to the resonator. The energy transferred to the tuning fork resonator will increase its amplitude of vibration until the energy losses of the resonator, due for example to the friction of its arms in the air, are again equal to the energy intake from the escape wheel. As the resonator can neither create nor lose energy it must in fact always vibrate at an amplitude that results in equality between the energy provided by the escape wheel and the energy lost due to friction and other losses. Since the losses increase with the amplitude of vibration, it is clear that the amplitude of vibration must increase if the energy (torque) transmitted to the resonator increases.

The greater the amplitude of vibration becomes, the greater the braking becomes at the same phase shift. Although the operating range of the escapement according to the invention as shown in FIG. 8 is already quite broad and ample for a practical application, the physics of the system demonstrates that the operating range is in fact even greater still.

The tuning fork resonator according to the invention has a very different shape from the U shaped tuning fork described in EP Patent Application No 2466401A1. As shown in FIG. 2, the tuning fork is formed of two arms attached to a stem 15 in the form of a solid plate. This geometry has several advantages with respect to the prior art resonator shown in FIG. 1. These advantages result from movements and deformations inside this tuning fork structure. The tuning fork according to FIG. 2 deforms as though the two arms 16 and 17 were embedded and immobile in their base and oscillate at their free end in a left-right motion in counterphase. It is noted that this motion of the arms is a first approximation with no motion in the lengthwise direction of the tuning fork. The tuning fork stem 15 therefore does not move, it is subjected to stresses from the oscillating arms. These stresses deform stem 15 in proximity to the bases of the tuning fork arms, but are very quickly and strongly attenuated towards the base of the stem. This offers the possibility of a simple and solid method of assembly in the lower area of stem 15, for example by screws as shown in FIG. 2. There is consequently obtained a tuning fork resonator with low vibrational energy losses in the fixed support and simultaneously a solid assembly satisfying the shock resistance requirements of a timepiece movement.

Figure 9:
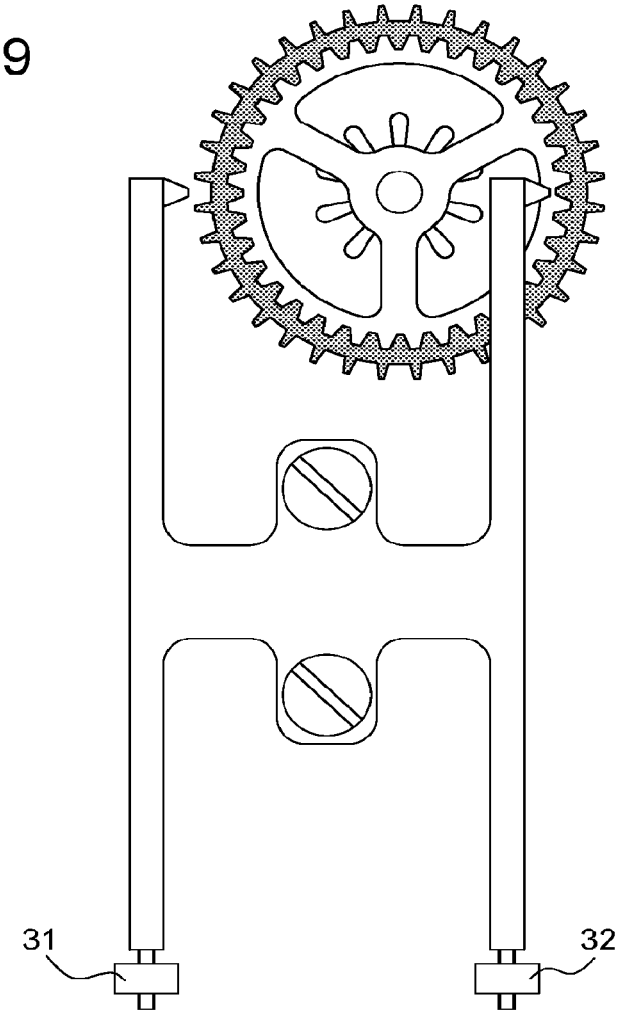
FIG. 9 shows the device according to the invention with a double resonator—H shaped tuning fork.

The structure illustrated in FIG. 2 is not the only possible resonator satisfying the requirements of a magnetic escapement according to the invention. FIG. 9 shows, by way of example, a double tuning fork structure. The double tuning fork structure offers the possibility of attaching weights 31 and 32 at the end of two additional arms. These weights 31 and 32 may be mounted in an adjustable position and make it possible to adjust the resonant frequency of the double tuning fork. Other methods of adjusting the chronometric frequency of a tuning fork are known to those skilled in the art, such as, for example, the removal of small quantities of mass at the end of the arms by laser ablation of material.

It goes without saying that this invention is not limited to the embodiments that have just been described and that various modifications and simple variants can be envisaged by those skilled in the art without departing from the scope of the invention as defined by the annexed claims.

It goes without saying, in particular, that a shield may be provided for the regulating system according to the invention and in particular for the escape wheel to limit or eliminate the influence of external magnetic fields on the operation of the system. Typically, it is possible to envisage two flanges made of a ferromagnetic material arranged on either side of the escape wheel.

According to another variant, it is also possible to replace the discrete permanent magnets with one of more magnetic layers, typically made of platinum and cobalt alloy (50-50 at. %) or of samarium cobalt.

Further, although the regulating system of the invention was described above in relation to the use of magnets and thus of magnetostatic forces, the invention also envisages replacing the discrete magnets or the magnetic layer or layers with electrets and electrostatic forces. Construction of the regulating system is entirely similar and sized according to the permanent electrostatic fields established between the resonator arms and the escape wheel. In summary, in this embodiment relying on electrostatic forces and torques, it is possible to use a conductive material either for the resonator arms if the escape wheel is electrically charged with sufficient energy, or for the escape wheel if it is the resonator arms that are electrically charged, this conductive material is locally polarized. Typically the tuning fork resonator can carry electrets at the end of each arm and the escape wheel is conductive or electrically charged locally, on the teeth of the wheel facing the electrets of the resonator, with opposite charges to the electrets of the resonator.

What is claimed is:

1. A system for regulating a mechanical timepiece based on magnetic interaction between a resonator and an escape wheel, the interaction creating radial and tangential forces acting on the escape wheel and generating torques therein, wherein the system is configured so that the torques due to the tangential forces act in opposite directions and cancel each other out when the resonator is stationary and a torque is applied to the escape wheel, wherein the resonator is a tuning fork, the tuning fork carries a permanent magnet on each arm, and magnetic flux from the magnets is directed towards an exterior of the tuning fork on one arm and towards an interior of the tuning fork on the other arm, and wherein the escape wheel carries a ferromagnetic structure in a form of a toothed crown with an inner toothing and an outer toothing arranged so that when one tooth of the inner toothing is opposite the magnet of one arm of the tuning fork, the magnet located on the other arm of the tuning fork is situated between two teeth of the outer toothing and vice versa.

2. The regulating system according to claim 1, wherein the escape wheel interacts with the resonator at each half oscillation of the resonator with substantially equal and opposite tangential forces.

3. The regulating system according to claim 1, wherein the tuning fork includes two arms attached to a stem with a width wider than that of the arms.

4. The regulating system according to claim 1, wherein the resonator carries a mechanism to adjust chronometric frequency in a form of adjustable inertia blocks arranged on the resonator structure or areas arranged to be removed by ablation.

5. The regulating system according to claim 1, wherein the permanent magnet is made in a form of one or more magnetic layers.

6. The regulating system according to claim 5, wherein the magnetic layer or layers are made of platinum and cobalt alloy.

7. A timepiece movement comprising a regulating system according to claim 1.

8. A system for regulating a mechanical timepiece based on electrostatic interaction between a resonator and an escape wheel, the interaction creating radial and tangential forces acting on the escape wheel and generating torques therein, wherein the system is configured so that the torques due to the tangential forces act in opposite directions and cancel each other out when the resonator is stationary and a torque is applied to the escape wheel, wherein the resonator is a tuning fork, wherein the tuning fork carries electrets on each arm, and wherein the escape wheel is conductive or electrically charged locally with opposite charges to the electrets of the resonator, wherein electrostatic flux from the electrets is directed towards an exterior of the tuning fork on one arm and towards an interior of the tuning fork on the other arm, and wherein the escape wheel carries a ferromagnetic structure in a form of a toothed crown with an inner toothing and an outer toothing arranged so that when one tooth of the inner toothing is opposite the electret of one arm of the tuning fork, the electret located on the other arm of the tuning fork is situated between two teeth of the outer toothing and vice versa.

9. A system for regulating a mechanical timepiece based on magnetic interaction between a resonator and an escape wheel, said interaction creating radial and tangential forces acting on the escape wheel and generating torques therein, the resonator defined by a tuning fork with two arms, wherein an axis of rotation of the escape wheel is closer to one of the two arms, wherein the system is configured so that the torques due to the tangential forces act in opposite directions and cancel each other out at a start of the system when a torque is applied to the escape wheel by a driving member while the system is still stationary in a start position, and wherein each of the two arms of the tuning fork includes a magnet which is arranged such that both N and S poles of the magnets are located only on one side of a plane of the escape wheel.

10. The system according to claim 9, wherein, on one of the two arms, the N pole of the magnet is closer to the plane of the escape wheel than the S pole of the magnet and, on the other of the two arms, the S pole of the magnet is closer to the plane of the escape wheel than the N pole of the magnet.

11. A system for regulating a mechanical timepiece based on magnetic interaction between a resonator and an escape wheel, the interaction creating radial and tangential forces acting on the escape wheel and generating torques therein, wherein the system is configured so that the torques due to the tangential forces act in opposite directions and cancel each other out when the resonator is stationary and a torque is applied to the escape wheel, wherein the resonator is a tuning fork, the tuning fork carries a permanent magnet on two arms, and magnetic flux from the magnets is directed towards an exterior of the tuning fork on one of the two arms and towards an interior of the tuning fork on the other of the two arms, and wherein the escape wheel carries a ferromagnetic structure in a form of a toothed crown with an inner toothing and an outer toothing arranged so that when one tooth of the inner toothing is opposite the magnet of the one arm of the tuning fork, the magnet located on the other arm of the tuning fork is situated between two teeth of the outer toothing and vice versa, and wherein the tuning fork takes a form of an H-shaped double tuning fork whose central portion serves as a base.

* * * * *